United States Patent [19]

Wehrmann et al.

[11] 4,224,693

[45] * Sep. 30, 1980

[54] HOSIERY PRODUCT

[75] Inventors: Nicholas Wehrmann; Charlie L. Williams, both of Wilkesboro, N.C.

[73] Assignee: Ithaca Textiles, Inc., Wilkesboro, N.C.

[ * ] Notice: The portion of the term of this patent subsequent to Feb. 5, 1997, has been disclaimed.

[21] Appl. No.: 14,686

[22] Filed: Feb. 23, 1979

Related U.S. Application Data

[62] Division of Ser. No. 914,588, Jun. 12, 1978, Pat. No. 4,186,471.

[51] Int. Cl.[2] ..... A41B 11/02; D04B 7/16

[52] U.S. Cl. ..... 2/241; 66/202; 60/182; 66/187

[58] Field of Search ..... 66/178 R, 178 A, 182, 66/185, 186, 187, 202; 2/239, 241; 8/21 B, 21 R; 28/154, 169

[56] References Cited

U.S. PATENT DOCUMENTS

| | | | |
|---|---|---|---|
| 1,444,786 | 2/1923 | Fleisher | 66/125 X |
| 1,728,546 | 9/1929 | Hemmerich | 28/154 |
| 2,714,757 | 8/1955 | Leath et al. | 28/169 X |
| 2,798,281 | 7/1957 | Herzog | 28/154 X |
| 2,913,801 | 11/1959 | Kessler | 28/154 X |
| 2,968,937 | 1/1961 | Margulies | 66/187 |
| 3,375,651 | 4/1968 | Greeson | 28/169 X |
| 3,417,174 | 12/1968 | Matray | 28/154 X |

*Primary Examiner*—Ronald Feldbaum
*Attorney, Agent, or Firm*—B. B. Olive

[57] ABSTRACT

A sheer hosiery construction and method is useful with sheer knee-high hosiery, panty hose, and other types of sheer, circular knit hosiery in which an appearance of substantial uniform color and sheerness, as worn, together with a reinforced toe are desired characteristics. A textured, relatively dull, nylon yarn is employed in knitting sheer leg and foot portions and then by yarn change a substantially non-textured, heavier, strand heat cured, relatively bright, nylon yarn is employed to knit the toe portion. An overall compatible yarn and fabric dye affinity is achieved which produces a sheer hosiery product having both a reinforced toe and an appearance of substantial uniform color and sheerness in the leg, foot and toe portions, as worn.

13 Claims, 2 Drawing Figures

HOSIERY PRODUCT

CROSS-REFERENCE TO RELATED APPLICATION

This application is a voluntary divisional application of copending application Ser. No. 914,588, entitled "The Method of Making Hosiery", filed June 12, 1978, now U.S. Pat. No. 4,186,471, dated Feb. 5, 1980.

BACKGROUND OF THE INVENTION

1. Field of the Invention

The invention relates generally to hosiery constructions and methods of manufacture. More particularly, the invention pertains to a sheer, circular knit hosiery product having both a reinforced toe portion and an appearance, as worn, of substantial uniform color and sheerness in the leg, foot and toe portions together with a method for producing such product.

2. Description of the Prior Art

It has been known to provide a circular, tubular knit, nude-type, sheer, nylon hosiery with a non-reinforced toe and with an essentially equivalent greige fabric dye receptivity in all portions of the hosiery. In this type of sheer hosiery, the respective leg, foot and toe portions are all typically knit of textured nylon of substantially the same weight and dye receptivity. A micro or plain Jersey stitch construction, or in a combination of the same, is typically employed with a textured yarn and an overall nude and sheer appearance of substantially uniform color in all portions of the hosiery, when worn, is obtained except for the welt which is conventionally darker. However, while the desired nude or other substantially uniform color and sheer appearance is obtained in the sheer hosiery, as worn, the reinforcement properties, i.e., the tear strength and abrasion resistant characteristics in the toe portion, are less than satisfactory.

Textured nylon yarn as referred to in the description is intended to include any textured continuous filament nylon yarn suited for hosiery, whether producer or trade textured, and having permanent loops, crimps, coils, crinkles, or the like, introduced by bulking, stuffing, knit-deknit, false twist, stretch, modified stretch, or the like. Non-textured nylon yarn as referred to in the description is intended to refer to any non-textured or at least substantially non-textured continuous filament nylon yarn suited for hosiery.

Normally, in order to achieve a substantially uniform nude appearance in such sheer hosiery as described above, the toe portion cannot be reinforced by using a heavier or additional yarn in its construction, since such reinforcement would result in the toe portion having a different appearance, when worn, from the appearance of the leg and foot portions of the hosiery, whether textured or non-textured nylon is used.

It has also been known to have reinforced toe and heel portions with a non-nude appearance, that is, where the toe and heel portions present a distinct contrast in gradation of color as compared to the sheer leg and foot portions of the hosiery, when worn. However, in this second example of prior art history, the toe portion and heel portion are reinforced typically by addition of an extra yarn or substitution of a heavier yarn which causes the hosiery, after dyeing and as worn, to display a darker shade in the toe and heel portions than is displayed in the leg and foot portions. Thus, in this second example, reinforcement of the heel and toe is obtained but the hosiery lacks the overall and desirable characteristic of uniform color in the leg, foot and toe portions.

In a third example of the prior art history, the toe is non-reinforced and nude appearing and compares to the non-reinforced toe of the first example while the heel is reinforced and of contrasting appearance as with the heel of the second example. In a fourth example, the sheer hosiery has had a non-reinforced, nude heel and a reinforced, non-nude toe which compares to the non-reinforced heel of the first example and the reinforced toe of the second example.

Thus, as to the four described prior art examples, it can be seen that while a nude or substantially uniform color appearance has been achieved as well as reinforced toe and heel constructions, the prior art has not provided a sheer hosiery product formed of synthetic yarn having leg and foot portions of textured yarn and a toe portion of non-textured yarn and of an overall sheer and nude or substantially uniform color appearance as worn and in which the toe portion is satisfactorily reinforced, i.e., by having commercially satisfactory tear strength and abrasion resistant characteristics.

U.S. Pat. No. 1,444,786 has taught the method of producing hosiery of variegated colors by using certain filament and fibrous yarns, a moistening treatment during knitting and a dye treatment having a different coloring action on the different threads. U.S. Pat. No. 1,728,546 teaches a hosiery construction and method which is also aimed at providing a variation in color in different portions of a hosiery product by using yarns having a different dye affinity. U.S. Pat. No. 2,798,281 is directed to an all-nylon hosiery product and method for obtaining a two-tone effect by using different types of nylon in various portions of the hosiery. U.S. Pat. No. 2,913,801 is directed to manufacture of hosiery with two types of polyamide threads of different dye affinity and dyed in one operation to produce a multi-color effect. U.S. Pat. No. 3,356,444 is directed to a dyed nylon fabric having two types of yarns of different cross-sectional shape and of different delustrant content. U.S. Pat. No. 3,417,174 is directed to a process for making dyed women's hose utilizing different types of copolyamide in the welt and leg portions and in which matched color in such portions is claimed to be achieved.

It has also been known that heat treating of sheer knitted hosiery fabric in the greige will affect dye affinity and will, therefore, affect the color obtained during dyeing of the product and, thus, will affect the appearance of the hosiery product, when worn. It has also been recognized that yarns can be given textured effects by employment of heat in a regulated heat-time cycle and that texturing of a yarn may affect dye affinity. In some texturing processes, strands of yarn in one textured state are fed through one or more heating zones to achieve another textured state. Both overfeeding and underfeeding of yarn strands is known to produce different textured effects. It is also known to achieve textured effects by autoclaving packaged yarn.

The reinforced toe construction, with commercially satisfactory tear strength and abrasion resistant properties, and nude appearance are both desirable characteristics for sheer hosiery. This is particularly true for the current popular type of sheer nylon hosiery in which micro or plain Jersey stitch constructions, or combinations of the same, are employed in the leg and foot portions. Yet, so far as is known and prior to the present invention, both characteristics have not been obtained simultaneously in a commercially satisfactory sheer hosiery product embodying textured nylon yarn in the leg and foot portions and non-textured, strand heat cured nylon yarn in the toe portion so as to obtain both an overall substantial uniformity in fabric dye receptivity as well as commercially satisfactory tear strength and abrasion resistant reinforcement properties in the toe. More specifically, what has been not been previously recognized is that both characteristics can be obtained in sheer, nylon hosiery by an appropriate selection of textured and non-textured yarns, heat curing of the non-textured yarn in strand form, knit constructions and dye treatment so as to produce, when worn, a substantially uniform color and sheer, e.g., nude, appearance in the leg and foot portions as well as in the toe portion of a sheer hosiery product having a reinforced toe.

Thus, the object of the present invention is that of producing a circular, tubular knit, sheer, nylon yarn hosiery product having both a reinforced toe portion and a substantial uniformity in color and sheerness, such as an overall substantially uniform nude, sheer appearance, when worn, in the leg, foot and toe portions.

SUMMARY OF THE INVENTION

The hosiery construction and method of the invention provide a sheer, circular knit, hosiery product formed from yarn derived from either nylon 6 or 66 and having both a reinforced toe portion and an overall sheer appearance of substantially uniform color throughout the hosiery, as worn. In the illustrated embodiment, the leg and foot portions are circular and tubular knit with a textured mid- or semi-dull nylon yarn and typically in either a sheer micro or plain Jersey stitch or in a combination of the same. Following a yarn change, the toe portion of the hosiery product of the invention is knit with a non-textured or at least substantially non-textured, relatively bright, nylon yarn and of a heavier weight relative to the weight of the textured nylon yarn used in the leg and foot portions. The textured leg-foot nylon yarn, as well as the non-textured toe yarn may be derived from either nylon 6 or nylon 66, but are preferably not mixed. Of unique importance, the non-textured, relatively bright, nylon yarn employed in the toe portion is, prior to being knit, passed in strand form through a controlled heat curing zone which is designed to change the dye receptivity of the substantially non-textured, relatively bright, nylon toe yarn and toe fabric knit therefrom, relative to the dye receptivity of the textured, dull or semi-dull nylon yarn used in the leg and foot portions and the leg and foot fabric knit therefrom. This heat strand curing treatment of the non-textured yarn is also designed to avoid imparting a textured character to the otherwise non-textured yarn. The result is that when the greige hosiery is dyed, preferably with a disperse dye, the hosiery product, as worn, exhibits a substantially uniform color and sheerness in the leg, foot and toe portions. The invention recognizes and advantage is taken of the fact that the heavier non-textured yarn produces a fabric which in character is more sheer than is fabric of the same construction using the same yarn of the same denier textured. Such differences in sheerness assist in achieving the desired substantial overall uniformity in sheerness of the knitted hosiery, as worn. Greatly improved and commercially satisfactory tear strength and abrasion resistant reinforcement characteristics are also obtained in the toe portion as compared to conventional sheer hosiery where no reinforcement is present in the toe portion.

DESCRIPTION OF THE PREFERRED EMBODIMENT

While applicable to sheer panty hose, sheer knee-high hosiery, and other types of sheer hosiery, the invention is explained using sheer, circular knit, knee-high hosiery as an example.

Figure 1:
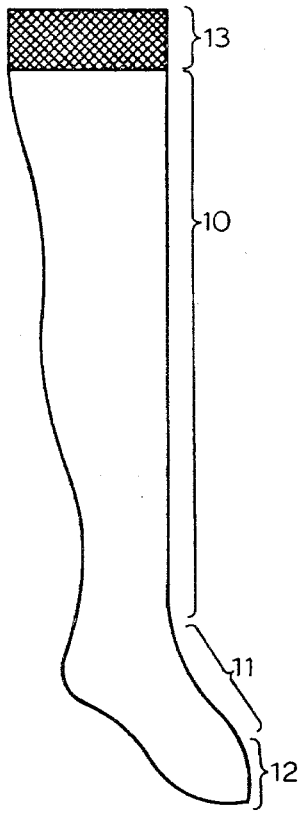
FIG. 1 represents a sheer, circular, tubular knit hosiery construction according to the invention having both a reinforced toe as well as an overall, substantially uniform color and sheer appearance, as worn, in the leg, foot and toe portions.
Figure 2:
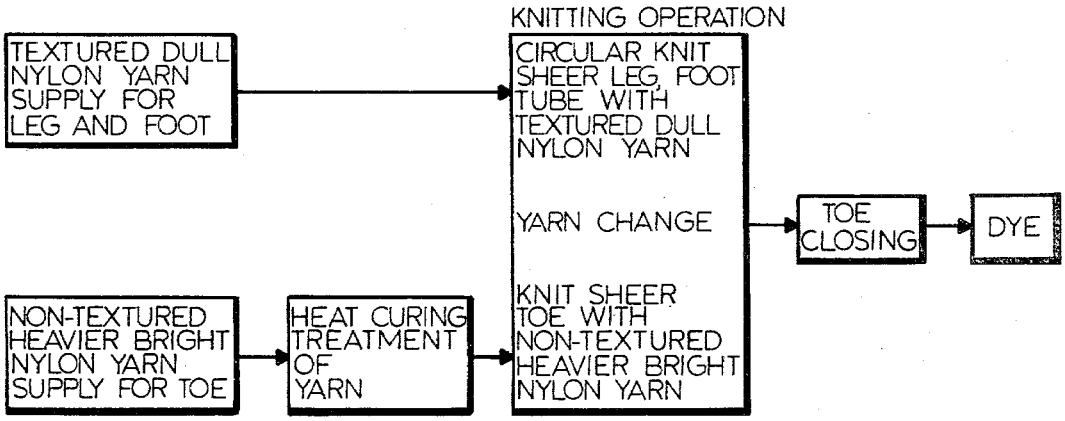
FIG. 2 diagrammatically represents the method of the invention.

Reference is made to FIGS. 1 and 2 which illustrate the product and method of the invention, respectively. The hosiery construction includes respective circular and tubular knit leg, foot, toe and welt portions 10, 11, 12 and 13. The welt portion 13 is of conventional construction and is normally darker than the remaining portions of the hosiery. However, an important object of the hosiery construction exemplified by FIG. 1 is to obtain a substantially uniform color and sheer appearance in the hosiery, as worn, with respect to the remaining leg, foot and toe portions 10, 11 and 12. Another characteristic obtained in the embodiment represented in FIG. 1 is that of having the toe portion 12 reinforced even though exhibiting substantially the same color and sheerness, when worn, as the leg and foot portions 10, 11. That is, the toe portion 12 is reinforced and as a result has a much improved and commercially satisfactory tear strength and abrasion resistance over that found in conventional nude-type hosiery where the toe portion is not reinforced. Nevertheless, an overall uniform color and sheer appearance of the leg, foot and toe portions 10, 11 and 12 is achieved in the hosiery of the invention.

With continuing reference to the embodiment illustrated in FIG. 1, the leg and foot portions 10, 11 are circular and tubular knit as sheer fabric preferably in a micro or plain Jersey stitch or in a combination of the same with a textured, relatively dull nylon yarn such as a mid- or semi-dull textured nylon 66 yarn. The toe portion 12 is also knit preferably in a micro or plain Jersey stitch or combination of the same but is knit with, for example, a non-textured or at least substantially non-textured, relatively bright, nylon yarn of heavier weight than that employed in the leg and foot portions 10, 11. Preferably, the non-textured toe yarn is at least 25 percent heavier in weight per unit than the textured leg-foot yarn in order to achieve a construction which is deemed commercially satisfactory for purposes of the invention. Also, the non-textured yarn which is employed in the toe portion 12 is, prior to being introduced into such toe portion 12 by a yarn change on the circular knitting machine, subjected, in strand form, to a carefully controlled, heat curing treatment which in the illustrated embodiment comprises a dry heat curing treatment designed to change the dye receptivity of such toe yarn and of the toe fabric knit therefrom but without melting or introducing a textured character. Furthermore, the stitch density in the toe portion 12 is selected in a manner designed to provide a substantially sheer greige fabric in toe portion 12 having a dye receptivity which matches that of the greige fabric in leg and foot portions 10, 11 so as to produce the desired overall substantially uniform color and sheer appearance in the leg, foot and toe portions of the hosiery. Also, as previously stated, the substantially uniform sheer appearance obtained in the hosiery, as worn, is enhanced by taking advantage of the fact that the heavier non-textured or at least substantially non-textured yarn produces a fabric which in character is more sheer than is fabric of the same construction using the same yarn of the same denier textured.

Thus, it has been discovered that sheer hosiery exhibiting a substantially overall uniform color and sheer appearance in the leg, foot and toe portions, when worn, as well as commercially satisfactory tear strength and abrasion resistant reinforced characteristics in the toe portion can be achieved by an appropriate control of fabric construction in the leg, foot and toe portions of the hosiery, control of the relative weights of yarn, use of a relatively dull, e.g. a mid- or semi-dull, textured nylon yarn in the leg and foot portions of one weight, use of a heavier substantially non-textured, relatively bright, nylon yarn in the toe portion and, most importantly, by applying, in the illustrated embodiment, a controlled dry heat curing treatment to the strand of non-textured yarn prior to being knit in the toe portion. The result is that the dye receptivities of the yarn and resulting fabric in the reinforced toe portion match the dye receptivities of the yarn and resulting fabric in the leg and foot portions so as to produce an overall uniform non-reinforced appearance of substantially uniform color and sheerness in the toe as well as in the leg and foot portions while still obtaining the desired reinforced properties in the toe portion. Although disperse-type dyes are generally preferred, other types suitable for dyeing circular knit nylon fabric may be used such as, for example, acid or direct dyes.

The heat treatment terminology "strand dry heat curing" has been selected to indicate that, in the later described embodiment, the non-textured, relatively bright nylon yarn at room temperature and in strand form, as distinguished from packaged form, is passed through a heating zone where the yarn is subjected to dry heat so that the yarn temperature is brought near but below its melting temperature over a time period required to accomplish the same. The heat treatment of the invention in the described embodiment represents a somewhat time extended heat exposure sufficient to alter the non-textured yarn's characteristic and the ultimate fabric dye characteristic as described. What may be happening in a molecular sense can be better appreciated by reference to the description appearing on page 19 of the book "Textured Yarn Technology", Vol. 1, 1967, published by the Monsanto Company. This reference indicates that partial melting and recrystallization of crystalline polymers can occur at temperatures below the measured melting point. In any event, the invention has taken unique advantage of the change in dye properties brought about by the described non-textured nylon strand dry heat curing treatment of the invention.

FIG. 2 illustrates in diagrammatic form the method of the invention. In reference to FIG. 2, it will be noted that the textured, dull, nylon yarn supply used in the leg and foot portions 10, 11 of the hosiery is brought directly from the supply to the knitting station. In contrast, the non-textured, or at least substantially non-textured, relatively bright, and heavier nylon yarn supply used in the toe portion is, prior to being knit, passed in strand form from room temperature through an appropriate heater where it undergoes a heat curing treatment designed to affect the dye receptivity of the toe portion produced therefrom but without imparting any substantial textured character to such yarn. The heat curing treatment of the toe yarn can be effected separately or in line with the knitting operation. However, because the heat curing treatment requires a slower yarn speed than that normally used in the knitting operation, such curing treatment is preferably accomplished as a separate operation.

An important advantage of the invention is that the required yarns are commercially available and, in the described embodiment, the curing dry heat treatment requires no special equipment. For such curing dry heat treatment, it is merely necessary that a zone having a controlled elevated temperature be provided through which the non-textured nylon yarn may be passed. When processing nylon 66, best results were achieved using a conventional 39" texturizing tube type heater when the thermocouple temperature of the heated zone read in the range of from about 200° C. to 245° C. and the yarn delivery rate was adjusted to give a dwell time of from 2.3 to 1.7 seconds. Commercially satisfactory results were achieved with the thermocouple temperature reading between 150° C. to 245° C. at the same feed rate. It was also found desirable that the yarn be passed through the dry heat curing zone under a minimum of tension with substantially no overfeeding or underfeeding. The yarn so treated exhibited no substantial textured character, A range of brightness for the non-textured toe yarn related to a yarn titanium dioxide content within the range of 0.01 to 0.15 percent by weight is preferred. A range of dullness related to a yarn titanium dioxide content with the range of 0.20 to 1.0 percent by weight is preferred for the textured leg-foot yarn. A minimum five-to-one weight ratio of the titanium dioxide content of the leg-foot yarn compared to the titanium dioxide content of the toe yarn is preferred.

Since the melting point of nylon 6 is lower than that of nylon 66, lower temperatures should be employed and feed rates adjusted to achieve the desired results of the invention when nylon 6 is employed for both yarns rather than nylon 66.

After the hosiery has been formed and the toe portion closed, the resulting hosiery product is then dyed, preferably with disperse dye, as later described. The overall result is that of obtaining a sheer, circular knit hosiery product having a substantially uniform color and sheer appearance in the leg, foot and toe portions, as worn, as well as commercially satisfactory reinforced, i.e., tear strength and abrasive resistant, characteristics in the toe portion.

In a specific example, a so-called Suntan shade hosiery was circular knit according to the invention. The welt portion was circular knit in a conventional manner. The leg and foot portions were knit in a sheer, plain Jersey stitch with an 18-3-298 (raw state) DuPont mid-dull nylon yarn which, prior to being knit, had been subjected to friction-type, false twisting. The leg and foot yarn thus constituted textured, mid-dull, nylon 66 yarn and prior to being introduced into the knit construction had no supplemental heat curing treatment other than as might have been required for the described texturizing of the yarn prior to being knit. The toe portion of the hosiery was also knit in a plain Jersey stitch using a heavier yarn consisting of two ends of DuPont 15-7-188 (raw state) bright nylon. The toe yarn thus consisted of a substantially non-textured, relatively bright nylon 66 yarn of heavier weight than the leg and foot yarn previously mentioned. Prior to being introduced into the knit construction, the mentioned toe yarn was passed through a thermocouple controlled tube-type texturizing dry heating device at the rate of 128 yards per minute at a thermocouple temperature of 245° C. Minimum tension without overfeed or underfeed was employed. The heated path was 39 inches in length. This dry heat curing treatment changed the dye receptivity of the toe yarn but the yarn itself was at a temperature sufficiently below its melting temperature so that no noticeable melting occurred. The toe yarn remained substantially non-textured after the treatment. The leg and foot portions of the hosiery were circular knit as a tube, 34 courses per inch and at a stitch density of 612 stitches per square inch. The toe portion of the hosiery was knit 38 courses per inch and at a stitch density of 760 stitches per square inch. These measurements were made in a maximum, i.e., 100%, stretched condition and showed a 24% difference in stitch density between the toe portion as compared to the leg and foot portions.

Following the knitting operation as described, the finished greige hosiery was sewn in a toe closing operation and then dyed in a mixture of disperse dyes. The dye medium consisted of BN 2074 grains of blue, RNA 1944 grains of scarlet and G 4579 grains of yellow dispersed in 250 gallons of water. Two hundred and sixteen pounds of dry hosiery equivalent to 576 dozen pairs were dyed in this mixture at a dye temperature of 170° F. for 45 minutes. The rate of rise from ambient temperature to the 170° F. dyeing temperature was at the rate of 2° F. per minute. The resulting hosiery had a substantially overall uniform tan-like color and sheer appearance in the leg, foot and toe portions, when worn. Such hosiery also exhibited in the reinforced toe portion commercially satisfactory abrasion and tear strength characteristics as desired. Thus, all of the objectives of the invention were achieved.

In summary, it can be seen that the so-called conventional type of sheer hosiery having substantially uniform color and sheerness in the leg, foot and toe portions but with no reinforcement in the toe and heel portions can be replaced with hosiery made according to the invention while maintaining the desired substantially uniform color and sheer appearance in the leg, foot and toe portions, as worn, and, in addition, obtaining desirable reinforcement characteristics in the toe portion which is most subject to wear, abrasion and bursting. An advantage of the invention is that conventional textured, relatively dull, nylon filament yarn, whether twisted, bulked, looped, curled, fluffed, knit-deknit, stretch, crinkled, or otherwise textured in the conventional sense, can still be employed in a conventional manner for knitting the leg and foot fabric of the hosiery without requiring special dye receptivity treatment of the yarn employed to knit such fabric. Equally important, the invention lends itself to employment of available non-textured, relatively bright, nylon filament yarns for knitting the toe fabric and whose dye receptivity can be made equivalent to that of the leg and foot fabric in the manner described. Another advantage of the invention is that the desired dry heat strand curing treatment applicable to the toe yarn can be applied with commercially available dry strand heating equipment and the dyeing operation can be effected by well-known dyeing techniques. Also, the heavier weight of the toe yarn relative to the leg-foot yarn weight can be selected so as to give a wide range of desired reinforcement properties in the toe portion corresponding with the weight of the selected toe yarn. Further, by recognizing and taking advantage of the fact that the heavier, non-textured yarn produces a fabric which in character is more sheer than is fabric of the same construction using the same yarn of the same denier textured, an attractive substantially uniform overall sheer appearance is achieved in the knitted hosiery, as worn.

What is claimed is:

1. A circular sheer nylon hosiery product having the appearance when worn of an overall substantial uniformity in color and sheerness in its leg, foot and toe portions together with reinforcement properties in the toe portion thereof, said hosiery product comprising:

(a) a sheer leg and foot portion knitted from a textured relatively dull, nylon yarn of a selected weight; and (b) a sheer closed toe portion knitted from a strand heat cured, substantially non-textured relatively bright nylon yarn of a selected weight sufficiently heavier than the weight of said leg and foot yarn to provide corresponding reinforcement and dye properties in said toe portion and in the hosiery product as worn both a reinforced toe portion and an overall appearance when post-knit dyed of substantial uniformity in color and sheerness throughout said leg, foot and toe portions.

2. The hosiery product according to claim 1 wherein said textured and non-textured yarns are both derived from nylon 66.

3. The hosiery product according to claim 1 wherein said textured and non-textured yarns are both derived from nylon 6.

4. The hosiery product according to claim 1 wherein said relatively dull textured yarn is a mid-dull nylon yarn.

5. The hosiery product according to claim 1 wherein said relatively dull textured yarn is a semi-dull nylon yarn.

6. The hosiery product according to claim 1 wherein said leg, foot and toe yarns after being knitted into said product have a post-knit disperse dye treatment on the visual surfaces thereof productive of said uniform color.

7. The hosiery product according to claim 1 wherein said relatively dull yarn has a titanium dioxide content of 0.01 to 0.15 percent by weight and said relatively bright yarn has a titanium dioxide content of 0.20 to 1.0 percent by weight.

8. The hosiery product according to claim 1 wherein the weight of said non-textured yarn is at least 25% heavier per unit length than the weight of said textured yarn.

9. The hosiery product of claim 1 wherein said toe yarn comprises a dry heat strand cured yarn.

10. The hosiery product according to claim 9 wherein said relatively dull yarn has a titanium dioxide content of 0.01 to 0.15 percent by weight and said relatively bright yarn has a titanium dioxide content of 0.20 to 1.0 percent by weight.

11. The hosiery product according to claim 10 wherein the weight of said non-textured yarn is at least 25% heavier per unit length than the weight of said textured yarn.

12. The hosiery product of claim 11 wherein said toe yarn comprises a dry heat strand cured yarn.

13. The hosiery product of claim 12 wherein said leg, foot and toe yarns after being knitted into said product have a post-knit disperse dye treatment on the visual surfaces thereof productive of said uniform color.

* * * * *

UNITED STATES PATENT AND TRADEMARK OFFICE

CERTIFICATE OF CORRECTION

PATENT NO. : 4,224,693

DATED : September 30, 1980

INVENTOR(S) : Nicholas Wehrmann; Charlie L. Williams

It is certified that error appears in the above—identified patent and that said Letters Patent is hereby corrected as shown below:

Col. 5, line 51, "yarn's characteristic" should be --yarn's dye characteristic--.

Col. 6, line 34, the comma should be a period.

Signed and Sealed this

*Twenty-eighth* Day of *July 1981*

[SEAL]

*Attest:*

GERALD J. MOSSINGHOFF

*Attesting Officer*

*Commissioner of Patents and Trademarks*